United States Patent [19]

O'Neill

[11] 4,137,912

[45] Feb. 6, 1979

[54] DIVING APPARATUS

[75] Inventor: Wilbur J. O'Neill, West Severna Park, Md.

[73] Assignee: Diver's Exchange Inc., Harvey, La.

[21] Appl. No.: 629,265

[22] Filed: Nov. 6, 1975

[51] Int. Cl.[2] ..... A62B 7/00

[52] U.S. Cl. ..... 128/142.3; 137/DIG. 8; 137/505.13

[58] Field of Search ..... 128/142, 142.2, 142.3, 128/142.5, 142.6, 145.8, 188, 203; 251/85; 137/DIG. 8, 505.13

[56] References Cited

U.S. PATENT DOCUMENTS

| | | | |
|---|---|---|---|
| 2,311,110 | 2/1943 | Johnson | 251/85 |
| 3,044,485 | 7/1962 | Adams et al. | 251/85 |
| 3,117,591 | 1/1964 | Schutmaat | 251/85 |
| 3,336,920 | 8/1967 | Thomas | 128/145.8 |
| 3,720,207 | 3/1973 | Matheny et al. | 128/142 |
| 3,859,994 | 1/1975 | Almqvist et al. | 128/142.3 |
| 3,924,616 | 12/1975 | Banjavich et al. | 128/142.3 |

*Primary Examiner*—Henry J. Recla

[57] ABSTRACT

A spring loaded accumulator is carried by a diver and is positioned within the gas circuit of a push-pull system wherein the diver is supplied with breathing gas from a remote source and exhaust gas is returned back to the source. The accumulator positioned in the return line reduces umbilical hose and pump capacity requirements. A regulator within the accumulator is positioned to limit the maximum differential pressure on the diver side of the return line.

8 Claims, 12 Drawing Figures

DIVING APPARATUS

BACKGROUND OF THE INVENTION

1. Field of the Invention

Diving apparatus of the closed loop push-pull type.

2. Description of the Prior Art

In a push-pull type breathing apparatus system the diver is supplied with breathing gas from a remote source by way of a supply line and exhaled gas is returned back to the source by way of a return line for gas conditioning such as $CO_2$ removal, oxygen replenishment, etc. In the design of such breathing systems, if one were to collect each discharged breath and measure the total volume discharged in one minute the pumping rate could be determined which, in man, is termed respiratory minute volume (RMV). During hard work, maximum inspiratory or expiratory flows are experienced and these are roughly three times the value of the RMV. Accordingly the hoses and pumps which provide gas to or remove gas from the diver must have three times the capacity if they must meet peak flows rather than RMV flows.

In the field of underwater diving, large volume tanks are sometimes utilized at the remote source to reduce pump requirements on the supply side to that of RMV flows and to smooth flow on the return side. However, even with the volume tanks the gas handling hoses must be large enough to adequately pass peak breathing velocities. In addition volume tanks become more inefficient with increasing depths of operation.

It is accordingly one object of the present invention to provide a system wherein not only pump capacity requirements are reduced but additionally the size and capacity of the gas handling hoses are reduced, an important consideration in that diver umbilicals should be kept as small and as flexible as possible to ease diver movement and to minimize stowage room and handling requirements.

In one type of push-pull system breathing gas is supplied to a diver's helmet and the helmet pressure is controlled by an exhaust control valve. The exhaust control valve discharges into the return line to the remote source. If a diver's task requires him to descend below the level of the remote source then the return umbilical must be designed to withstand a certain pressure differential which can be very significant and requires the provision of relatively stiff hoses from the diving helmet.

It is another object of the present invention to provide a device which will allow the employment of thinner walled, more flexible hoses to the helmet so as to allow greater freedom of movement by the diver.

SUMMARY OF THE INVENTION

The diving apparatus of the present invention includes a spring loaded accumulator in the return line, the accumulator being carried by the diver, as opposed to being carried by the remote source. This arrangement provides a significant reduction in hose size and the constructional details allow for a relatively small size unit so as to be carried by the diver, as opposed to the relatively large volume tanks carried by the remote source.

If desired, an accumulator may also be positioned in the supply line to accommodate for peak inspiratory flow rates.

Means are also provided within the spring loaded accumulator to regulate the pressure within the hose connecting the accumulator to the diver's exhaust control valve and for limiting the maximum pressure differential so as to allow for more flexible hoses and a lighter weight, thinner walled accumulator.

DESCRIPTION OF THE PREFERRED EMBODIMENT

Figure 1:
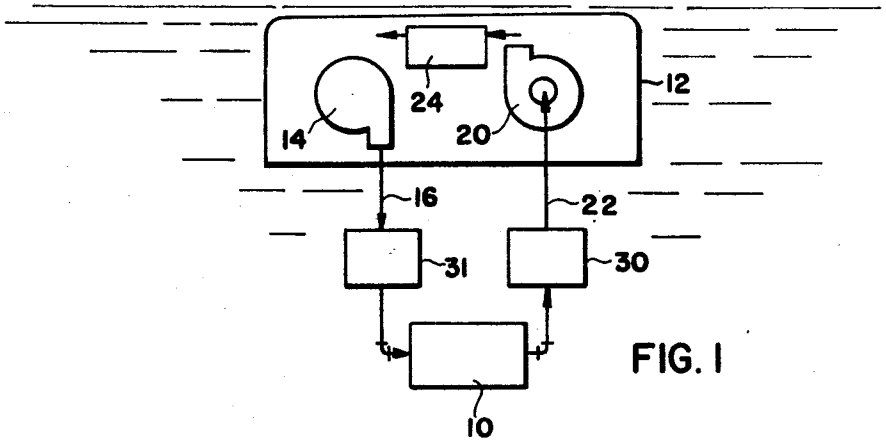
FIG. 1 is a diagrammatic representation of a push-pull breathing system incorporating the present invention.

FIG. 1 illustrates the basic components of a typical push-pull type of system in an underwater environment. Diver worn breathing apparatus 10 is supplied with breathing gas from a remote source 12 by means of a supply pump 14 and supply line 16 in the form of a flexible hose, or umbilical.

Exhaust gas made up of diver's exhaled gas and/or unused supplied gas is returned back to the remote source 12 by means of a suction source in the form of return pump 20 and return line 22 which, like supply line 16, is in the form of a flexible hose.

Returned gas is processed by conditioning apparatus indicated generally at 24 for removing $CO_2$, oxygen replenishment, dewatering, etc., after which it is returned to the diver by way of the supply pump 14.

In order to reduce the design capacity of the return pump 20 and return line 22 the present invention provides an accumulator means 30 positioned in the gas return line and carried by the diver. Depending upon the design of the diver worn breathing apparatus 10, it may be desirable to put a somewhat similar accumulator means 31 on the input, or supply side, to accommodate for peak inhalations, as will be described.

Figure 2:
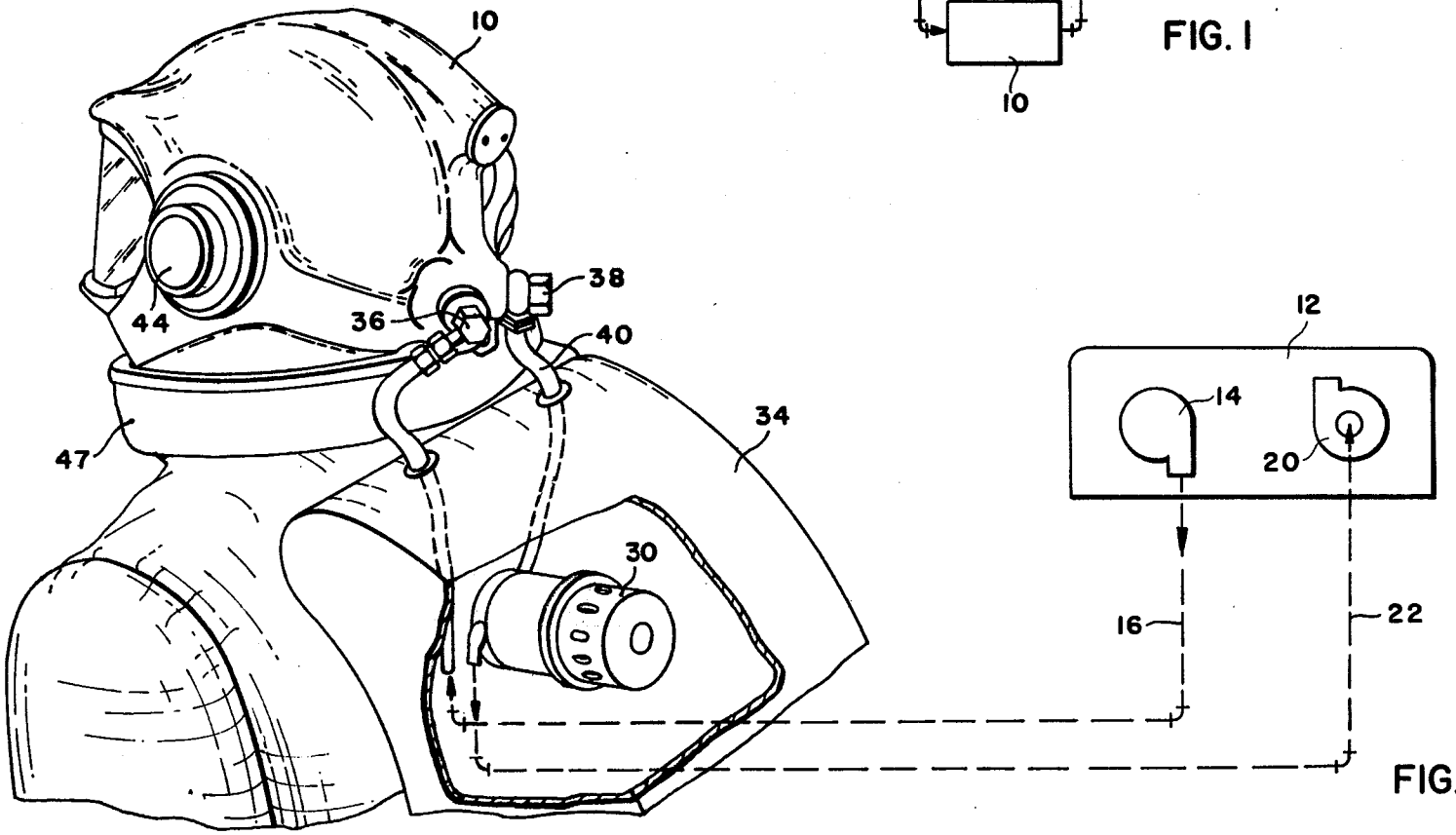
FIG. 2 illustrates the accumulator as carried by a diver.

FIG. 2 illustrates the arrangement of FIG. 1 in somewhat more detail and includes a diving helmet 10 as the diver worn breathing apparatus. Accumulator 30 is carried by the diver in a back pack 34, partially broken away to illustrate the mounting of the accumulator 30. The supply line 16 supplies breathing gas to the helmet at input connection 36 and exhaust gas is conducted from output connection 38 through helmet hose 40 to the accumulator 30, and then to return line 22.

The diving helmet 10 is provided with first and second serially arranged valves, a fail-safe valve 44 and an exhaust control valve, not illustrated in FIG. 2, but positioned diametrically opposite valve 44 over the diver's right ear location. Such diving helmet and gas circuit are more fully described and claimed in copending applications Ser. Nos. 531,845 and 531,849 both filed Dec. 11, 1974 and both assigned to the same assignee as the present invention and hereby incorporated by reference.

In the helmet design there is incorporated a neck seal 47 which is operative in certain circumstances to act as an accumulator, thus eliminating the need for an accumulator on the input side of the system. Details of such helmet construction are further described and claimed in copending application Ser. No. 306,944, filed Nov. 15, 1972 and assigned to the same assignee as the present invention and hereby incorporated by reference.

Figure 3B:
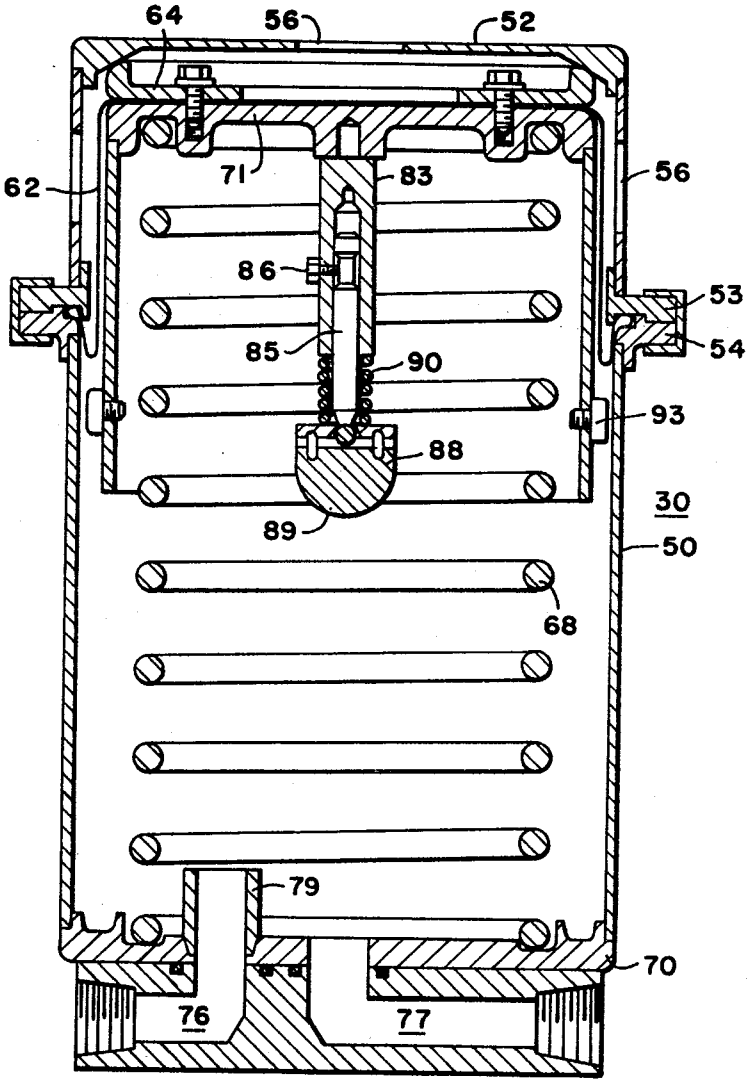
FIGS. 3A and 3B are sectional views of the accumulator at two different points in its operation.
Figure 3A:
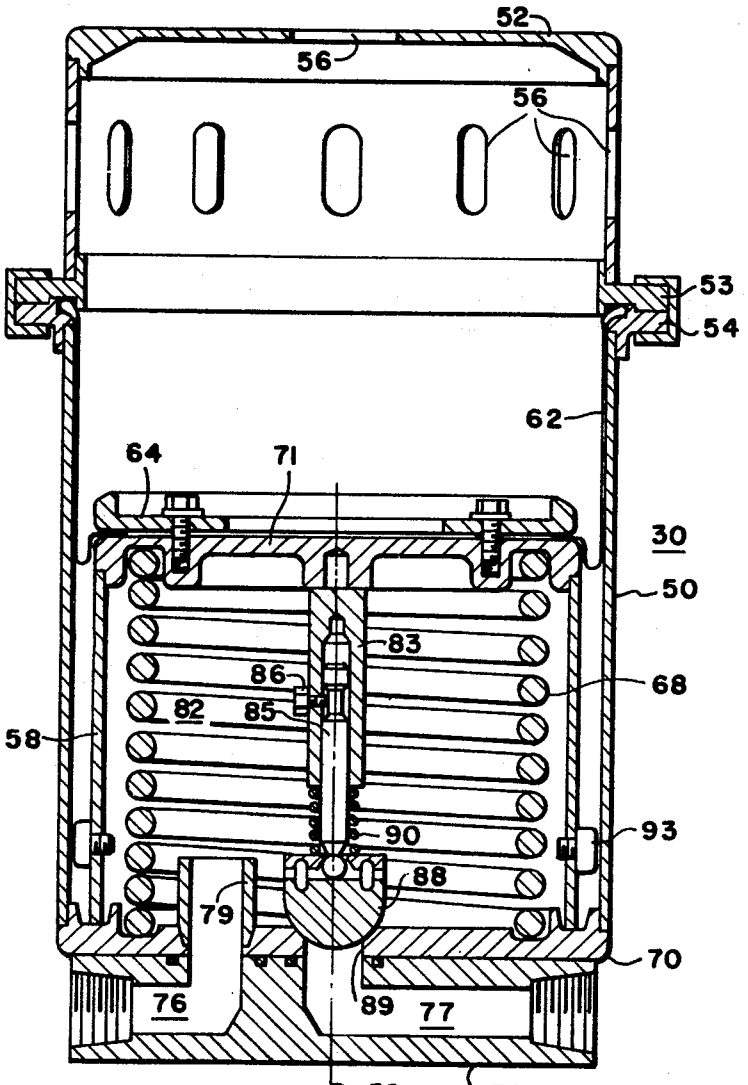

FIG. 3A illustrates a central cross-sectional view of the accumulator 30, the outer container assembly including a cylindrical body member 50 and a cap assembly 52 secured thereto by means of clamped together retaining rings 53 and 54 and having a plurality of apertures 56 therein for communication with the surrounding ambient water medium.

A piston 58 is movable along the central axis 59 and is separated from that portion of the assembly open to the water medium by means of a long stroke rolling diaphragm 62 held in place by means of retaining rings 53 and 54 and secured to the piston 58 by means of a retaining plate 64.

The diaphragm means separates the assembly into a first volume open to the ambient water and a second volume containing the piston 58 and in gas communication with the diver's helmet and the return line.

The accumulator is spring loaded with the provision of spring 68 which is illustrated in a compressed condition between bottom cap 70 and piston cap 71 and the force of which opposes the ambient water pressure acting over the effective area of diaphragm 62.

Block 74 contains gas passageways 76 and 77 with passageway 76 being in open gas communication with the helmet hose 40 whereby exhaust gas passes to the interior of the accumulator by way of insert tube 79.

As illustrated in FIG. 3A, gas passage 77, connected to return hose 22 is blocked from communication with the interior of the accumulator 30 by virtue of plunger assembly 82. More particularly the plunger assembly 82 includes a rod 83 connected to piston cap 71 and which includes a central aperture for receiving a stem 85 axially movable therein with its movement being limited by cap screw 86. Stem 85 is connected to a stop assembly or poppet 88 which seals off valve seat 89 in the position illustrated. A small spring 90 extends between the poppet 88 and the underside of rod 83 and assists in preventing the poppet from slamming shut when the piston moves into the position illustrated in FIG. 3A.

As the gas flow from the helmet into the accumulator increases, piston 58 will move axially upward (for the orientation of FIG. 3A) guided by means of, for example nylon screws 93. As the pressure increases, the poppet 88 will be lifted off of valve seat 89 so that gas can exit through passageway 77 to be returned to the remote source.

As the pressure within the assembly 30 increases the piston will move to a position such as illustrated in FIG. 3B whereby excess exhaust gas is being accommodated by the accumulator.

Figure 4:
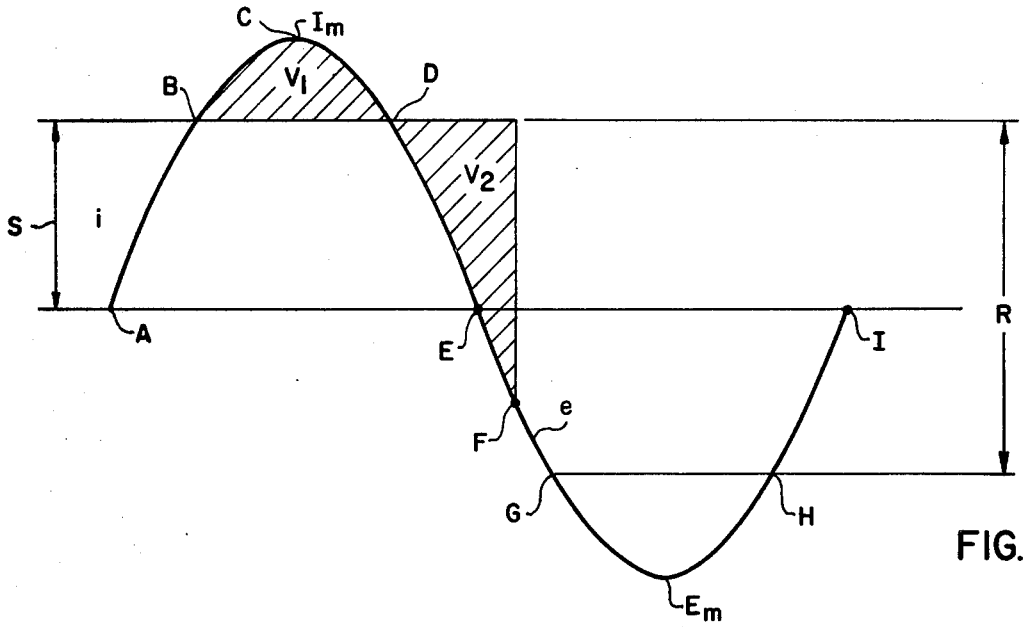
FIG. 4 illustrates a idealized breathing curve.

Before proceeding with a detailed explanation of the operation of the present invention an examination of a typical breathing cycle would be beneficial and to this end reference is made to FIG. 4 which represents an idealized breathing cycle with time plotted on the horizontal axis and flow rate plotted on the vertical axis.

Diver inhalation is represented by the positive portion of the curve from A to E and exhalation by the negative portion of the curve from E to I. Let it be assumed that the supply rate of breathing gas is S liters per minute and that the return capability of the return line 22 and return pump 20 is R liters per minute where R is greater than S. At point A the diver begins his inhalation and at point B the inhalation rate equals the supply rate S. Inhalation proceeds up to point C representing a maximum inhalation rate $I_m$ which occurs in a situation where the diver is doing relatively hard work. Since the inhalation rate exceeds the supply, the diver is provided with the necessary breathing gas from the neck seal 47 (FIG. 2).

The inhalation rate decreases from its maximum and at point D the inhalation rate again equals the supply with the volume $V_1$ defined by the area BCD being equal to the volume of gas obtained from the neck seal. Since the inhalation rate is less than the supply rate from point D to E, the excess gas supply goes to refill the neck seal, with the shaded volume $V_2$ representing that amount of total gas filling up the neck seal, with volumes $V_1$ and $V_2$ being equal.

At point E inhalation has ceased and exhalation commences and it is seen that the first part of the diver's exhalation is utilized to fill up the neck seal, a situation made possible in view of the fact that the first portion of the exhaled breath is generally $CO_2$ free. During the inhalation period from A to E, where the instantaneous value of inhalation rate is represented by i, the previously mentioned exhaust control valve on the diver's helmet is operable to maintain a predetermined pressure relative to the ambient water pressure at the valve.

At point F in the exhalation cycle the exhaust control valve remains open to exhaust the diver's exhalation, the instantaneous value of which is represented by e, plus all the gas being constantly supplied at the rate S. When $S + e = R$, at point G, the return capacity is met. However, the exhalation curve still proceeds to a maximum $E_m$. In the present invention, this excess exhalation is taken up by the accumulator from G to H, thus reducing the design capacity requirement of the return system. Exhalation continues at a decreased rate from H to I after which the breathing cycle would repeat.

FIGS. 5A through 5D illustrate the operation of the present invention with reference to the exemplary breathing curve of FIG. 4. For ease of explanation of the accumulator operation, the regulation feature provided by the plunger assembly 82, (FIG. 3A) is not illustrated.

Figure 5A:
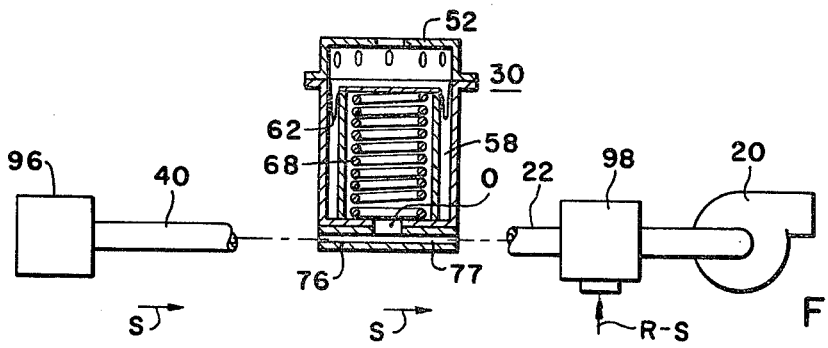
FIGS. 5A through 5D are schematic illustrations of the operation of the present invention at corresponding points in the curve of FIG. 4.

In FIG. 5A the exhaust control valve 96 positioned on the helmet, discharges gas to the helmet hose 40 which connects with return line 22 connected to the return pump 20 by way of a pressure relief valve 98, both return pump and pressure relief valve 98 being located within the underwater remote source.

Let it be assumed for purposes of illustration that the diver is working at a depth of 100 feet below the remote source where the ambient water pressure would be approximately 45 pounds per square inch (psi) greater than that at the remote source. This 45 psi represents a pressure differential which the hoses and the accumulator (since it is connected to the hoses) must withstand.

Figure 5B:
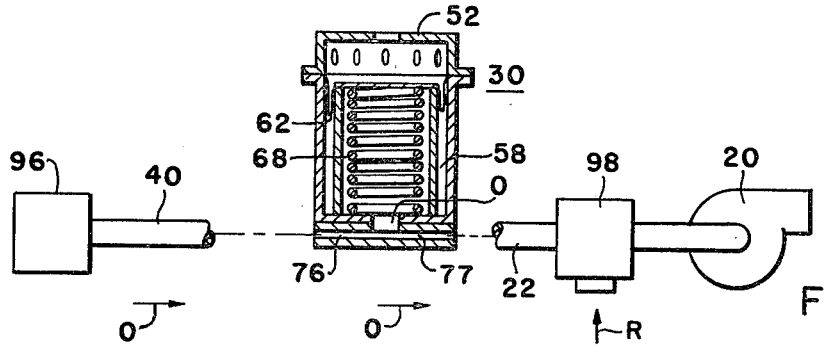

In some supply-return systems, the return pressure at the underwater source is set at a negative value relative to the source to allow for excursions above the level of the source and in such instance there would be even a greater pressure differential at the 100 foot level. For ease of explanation, various compressibility effects and pressure drops due to flow within the hoses, have been neglected. At point A in the breathing cycle there is zero inhalation and all of the supply gas is exiting the exhaust control valve (except if it is pressure regulating) 96 such that S liters per minute is flowing in helmet hose 40 and the return line 22. Since the return pump 20 is designed for a constant capacity of R liters per minute (R is greater than S) the pressure relief valve 98 is operable to make up the difference R − S liters per minute. At point A therefore, there is no net flow into or out of the accumulator 30. As the diver inhales the supplied gas, the flow rate in the helmet hose 40 and return line 22 decreases and at point B, as illustrated in FIG. 5B, there will be zero flow in the helmet hose 40 and return line 22. The total pump capacity therefore is provided by the gas within the remote source by way of pressure relief valve 98. Piston 58 of accumulator 30 remains in the down condition with zero net flow into or out of the accumulator.

Figure 5C:
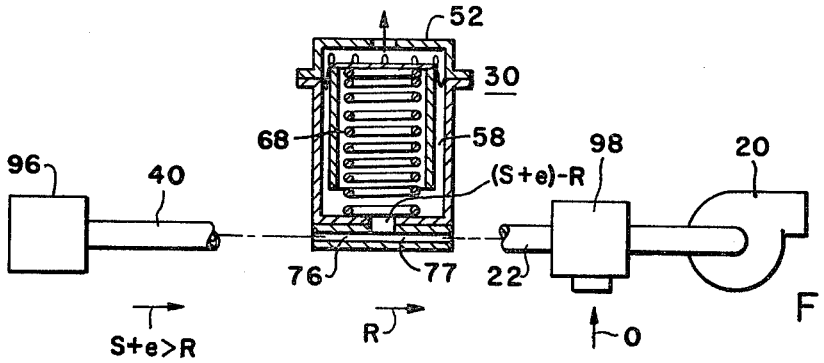

Once past point D, the flow rate will increase within the hoses and when the exhalation rate e passes through point G, the situation will be as is illustrated in FIG. 5C. Exiting from the exhaust control valve 96 is a flow rate equal to S + e where S + e > R. Return line 22 has its maximum flow rate R and accordingly the difference (S + e) − R flows into accumulator 30 whereby piston 58 moves axially in the direction of the arrow. With the piston displaced from its previous position, the accumulator 30 now controls the pressure in the helmet hose 40 and return line 22 in the vicinity of the accumulator 30 which for a typical design may be, for example, between −10 psi and −5 psi relative to ambient.

Figure 5D:
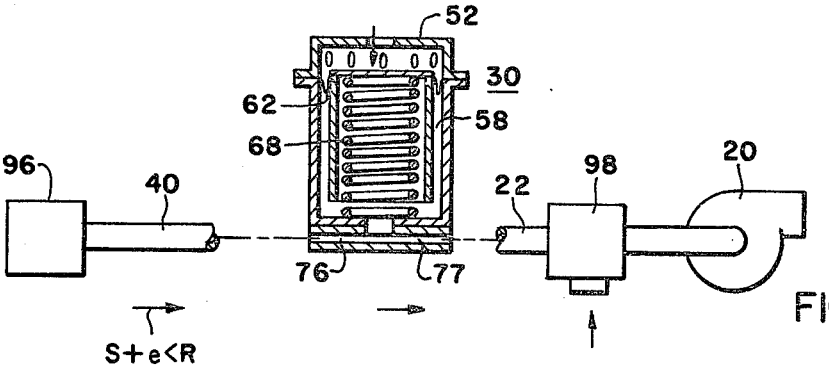

At point H the piston 50 will have traveled to its maximum rise position and thereafter will start descending to its lower position, as illustrated by the arrow in FIG. 5D representing the situation from point H on. Depending upon exhalation effort the piston 58 may or may not extend to a position where it would bottom out, that is, contact the cap assembly 52.

Figure 6:
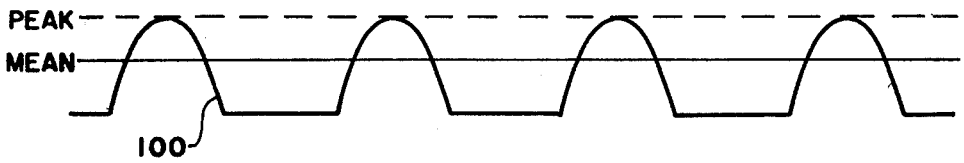
FIG. 6 is a curve illustrating gas flow rate as a function of time.

The advantage of the accumulator 30 carried by the diver can be seen in FIG. 6 wherein curve 100 represents diver exhalation as a function of time in a heavy work situation. Normally the return line and pump capacity would have to be designed for a flow rate indicated by the dotted peak line. With the present invention the flow requirement is reduced to the RMV flow indicated by the solid mean line.

During the breathing cycle, and as illustrated in FIGS. 5A through 5D, the helmet hose 40 is subject to a differential pressure ranging from approximately −5 psi to a maximum of approximately −45 psi, for the 100 foot diver depth. In order to withstand this high differential pressure the helmet hose 40 must be relatively strong and rigid. In addition the cylinders of the accumulator 30 must be designed to withstand the same relatively high differential pressure. In the present invention, the maximum differential pressure experienced by the accumulator 30 is limited to approximately −10 psi with the consequence that the cylinders of the accumulator can be thinner resulting in a lighter weight device. In addition the present invention limits the pressure differential in the diver hose 40 to a maximum of approximately −10 psi thereby allowing for a thinner walled more flexible hose and consequently, greater diver head movement.

Figure 7A:
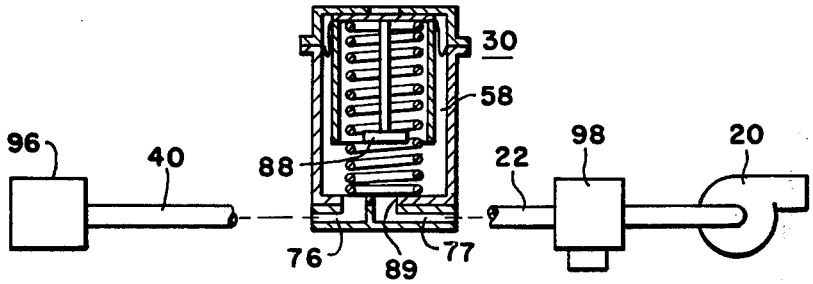
FIGS. 7A and 7B are schematic illustrations of the accumulator-pressure regulation operation.
Figure 7B:
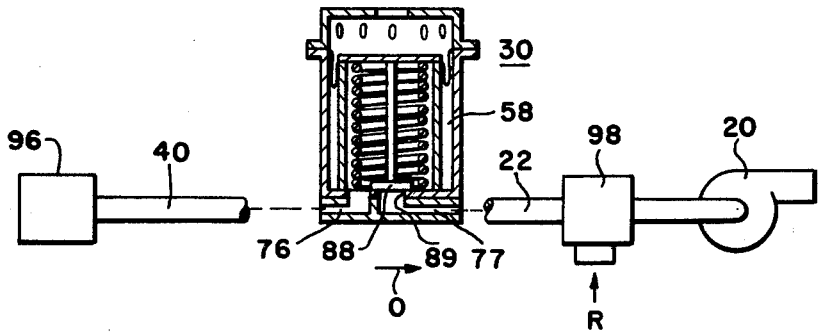

Basically, and with reference to FIGS. 7A and 7B and with further reference to FIG. 3A, the limitation of maximum pressure differential is accomplished by cutting off gas communication between the return line 22 and diver hose 40 so that the maximum pressure differential is determined by the spring force in its compressed condition acting over the effective area of the diaphragm, which in the present example results in a maximum pressure of −10 psi relative to ambient.

In FIG. 3A gas from helmet hose 40 enters the accumulator 30 by way of insert tube 79. As the pressure in the accumulator increases the piston moves axially and poppet 88 will move off of valve seat 89 allowing gas communication through passageway 77 with the return hose 22. FIG. 7A represents the piston 58 at some relative position which limits the pressure within the accumulator 30 and helmet hose 40 to some value between −10 and −5 psi relative to ambient. Without the pressure regulation feature and as previously illustrated, the piston in its fully down position resulted in a pressure differential, for the 100 foot depth of 45 psi. With the pressure regulation feature, and as illustrated in FIG. 7B, poppet 88 closing valve seat 89 cuts off gas communication with the return line 22 and accordingly the pressure within the accumulator and therefore helmet hose 40 is limited to the −10 psi value.

While functioning as a pressure regulator, the piston 58 and accordingly poppet 88 may move up and down to a limited extent to allow excess gas to be exited to the return line 22. If the breathing is of a magnitude such that accumulator action comes into play, as more gas goes into the accumulator the spring force decreases because it is extending, however the upstream pressure within the helmet hose 40 will be limited to that range previously discussed and when the poppet 88 again seals off gas communication with the return line 22 the pressure differential is again maintained at a tolerable maximum which allows for a more flexible and thinner walled helmet hose 40 and a thinner walled and lighter weight accumulator unit. The same hose and accumulator unit may be utilized with various pumping systems including those wherein an even greater pressure differential than that described, exists in the return line at the accumulator location.

In one type of system, described U.S. Pat. No. 3,965,892, filed Feb. 13, 1975 and assigned to the assignee of the present invention, a supply pump and return pump are provided with a differential pressure control arrangement that keeps a relatively low pressure differential between the supply and return line no matter what the diver depth. However even with a tolerable pressure differential the accumulator means may still be utilized to further reduce the maximum pressure differential at the diver hose and to also allow for a return system de- to meet mean capacities as opposed to peak capacities.

In the example described, part of the gas supplied, when the diver's work rate was such as to required it, came from the neck seal of the diving helmet. As an alternative, the spring loaded accumulator of the present invention could be carried by the diver on the input line 16 however without the plunger assembly 82 and with the spring 68 placed on the opposite side of the diaphragm 62 so as to urge the piston 58 toward its extreme lower position. The spring design would be such that incoming gas would maintain the piston 58 in an upper position providing a reservior of useable gas, should the diver inhalation rate exceed the supply rate.

I claim:

1. Diving apparatus wherein the diver is provided with breathing gas via a supply line from a source remote from the diver and exhaust gas is returned back to said source via a return line, the improvement comprising:

(a) spring loaded accumulator means;
(b) said accumulator means being connected in gas communication to said return line at the diver location.

2. Apparatus according to claim 1 which includes:
(a) regulator means for limiting the maximum pressure differential within said accumulator means, relative to the ambient water medium.

3. Apparatus according to claim 1 wherein said accumulator means includes:
(a) an outer container assembly;
(b) an inner piston assembly movable with said outer container assembly;
(c) diaphragm means positioned within said outer container assembly and being connected to said piston assembly and defining first and second volumes;
(d) said first volume being communicative with the surrounding water medium;
(e) said second volume containing said piston assembly; and being in gas communication with said return line;
(f) spring means positioned relative to said piston assembly to oppose the ambient water pressure acting over the effective area of said diaphragm means.

4. Apparatus according to claim 3 wherein:
(a) said spring means is a spring positioned within said piston assembly.

5. Apparatus according to claim 3 which includes:
(a) regulator means for cutting off said gas communication with said return line whereby the pressure within said second volume is limited to a maximum value relative to ambient.

6. Apparatus according to claim 5 which includes:
(a) a diver hose for conduction of exhaust gas, in open gas comunication with said second volume.

7. Apparatus according to claim 6 wherein said regulator means includes:
(a) a plunger assembly connected to and movable with said piston assembly;
(b) said plunger assembly including a poppet;
(c) a valve seat in gas communication with said return line and closable by said poppet.

8. Apparatus according to claim 7 wherein:
(a) said plunger assembly is movable, within limits, relative to said piston assembly.

* * * * *